US005497168A

United States Patent [19]

Thomas et al.

[11] Patent Number: 5,497,168

[45] Date of Patent: Mar. 5, 1996

[54] RADIATOR BANDWIDTH ENHANCEMENT USING DIELECTRICS WITH INVERSE FREQUENCY DEPENDENCE

[75] Inventors: Michael D. Thomas, Thousand Oaks; Ronald I. Wolfson; Jerome I. Glaser, both of Los Angeles; Joseph P. Smalanskas, Westchester; Shane H. Hunter, Redondo Beach; Allen M. Tran, Torrance, all of Calif.

[73] Assignee: Hughes Aircraft Company, Los Angeles, Calif.

[21] Appl. No.: 286,105

[22] Filed: Aug. 4, 1994

Related U.S. Application Data

[63] Continuation of Ser. No. 878,706, May 1, 1992, abandoned.

[51] Int. Cl.[6] ..... H01Q 19/10

[52] U.S. Cl. ..... 343/834; 343/846; 343/909

[58] Field of Search ..... 343/909, 872, 343/846, 848, 789, 754, 834, 767; H01Q 19/10

[56] References Cited

U.S. PATENT DOCUMENTS 2,840,820 6/1958 Southworth ..... 343/909

4,288,337 9/1981 Ota et al. ..... 343/909

FOREIGN PATENT DOCUMENTS 557046 2/1983 U.S.S.R. ..... 343/787

814310 6/1959 United Kingdom ..... 343/909

OTHER PUBLICATIONS

P. Callaghan, et al., "Influence of supporting dielectric layers on the transmission properties of frequency selective surfaces", IEEE Proceedings–H, vol. 138, No. 5, Oct. 1991, pp. 448–454.

*Primary Examiner*—Michael C. Wimer

*Attorney, Agent, or Firm*—Leonard A. Alkov; W. K. Denson-Low

[57] ABSTRACT

A dielectric material having a dielectric constant which varies inversely with frequency, and preferably with the second power of frequency, fills the space between a radiator and a reflecting groundplane. The back-directed wave is reflected back to the radiator in phase with the directly radiated wave over a wide frequency band, increasing the radiator efficiency.

17 Claims, 7 Drawing Sheets

RADIATOR BANDWIDTH ENHANCEMENT USING DIELECTRICS WITH INVERSE FREQUENCY DEPENDENCE

This is a continuation application Ser. No. 07/878,706, filed May 1, 1992 abandoned.

BACKGROUND OF THE INVENTION

The invention relates to electromagnetic energy radiating elements of the type usable in an array antenna, and more particularly to a method for maintaining an effective electrical pathlength of about one-quarter wavelength between the radiator and groundplane over a multi-octave band of frequencies.

Certain radiating elements, for example, a slot in a groundplane, radiate with equal amplitude in both the forward and back directions. In order to utilize this type of radiator in a practical array antenna, the back-directed wave must be taken into account. The most common approaches are either to absorb the misdirected signal in an RF load material or to recapture it by means of a reflecting groundplane spaced the proper distance behind the radiator. When this spacing is nominally one-quarter wavelength at the operating frequency, the forward and reflected waves reinforce one another to produce maximum radiation efficiency.

The drawback with suppressing the back-directed wave with absorbing material is that one-half of the total energy is lost in the absorber. Nevertheless, ultrawide-band performance is achieved, which makes this type radiator attractive for passive surveillance systems. Active systems, however, normally cannot tolerate the excess roundtrip loss of 6 dB as transmit power would need to be quadrupled in order to keep the same range performance. Absorber loading is described in R. C. Johnson and H. Jasik, "Antenna Engineering Handbook." New York: McGraw-Hill, 1984, pages 14–14 through 14–24.

Radiator efficiency can be maximized by means of a properly spaced, reflecting groundplane or alternately, a cavity of the proper depth. FIG. 1 shows how radiator gain varies with cavity depth in wavelengths. Equivalently, gain falls off 3 dB at 0.5 and 1.5 times the band center frequency. Operation outside this band leads to phasing problems with the two signals, i.e., further reduction in gain and eventually, pattern nulls from destructive cancellation. Furthermore, the radiator cannot be arrayed in tight lattices as the cavity must be made large enough to remain above cut-off at the lowest operating frequency.

The reflecting groundplane behaves similarly to a cavity. FIG. 2 illustrates how gain (equivalent here to radiation efficiency) varies with space, S, between the dipole radiator and the groundplane. When the effective electrical path length between the radiator and groundplane is one-quarter wavelength, the reflected energy will be in phase with the directly radiated energy, thereby reinforcing the directly radiated energy to produce the maximum radiator efficiency. The signals are in phase because there is a 90° lag due to travel to the reflecting surface, a 180° phase reversal resulting from the reflection, and another 90° lag due to travel back to the radiator, thus totalling 360°. Note that at a spacing of one-half wave-length, the gain drops to zero due to cancellation of the forward and reflected waves. The use of a reflecting groundplane is described in J. D. Kraus, "Antennas," New York: McGraw-Hill, 1950, at page 327.

It is therefore an object of the present invention to provide a radiating element comprising a radiator and a reflecting groundplane located at an effective electrical pathlength from the radiator which is maintained at about one-quarter wavelength over a multioctave band of frequencies.

A further object is to provide a dielectric material having a dielectric constant that varies in some inverse manner with frequency, preferably as $1/f^2$.

SUMMARY OF THE INVENTION

A frequency independent groundplane is described for an array antenna having a radiating surface and a reflecting groundplane. The groundplane is separated from the radiating surface by a nominal constant spacing distance equivalent to one-quarter wavelength at a nominal frequency within the frequency band of interest. A dielectric material is disposed between the radiator and the ground-plane which has a relative dielectric constant that varies in an inverse function with frequency. Ideally, the inverse function is $1/f^2$, where f represents the frequency, whereby an effective electrical path length of about one-quarter wavelength is maintained between the radiator and the groundplane over a wide frequency band.

In accordance with another aspect of the invention, a dielectric material is provided having a dielectric constant characterized by an inverse frequency dependence, preferably $1/f^2$. Such a material can have wide utility in a variety of microwave applications.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 3:
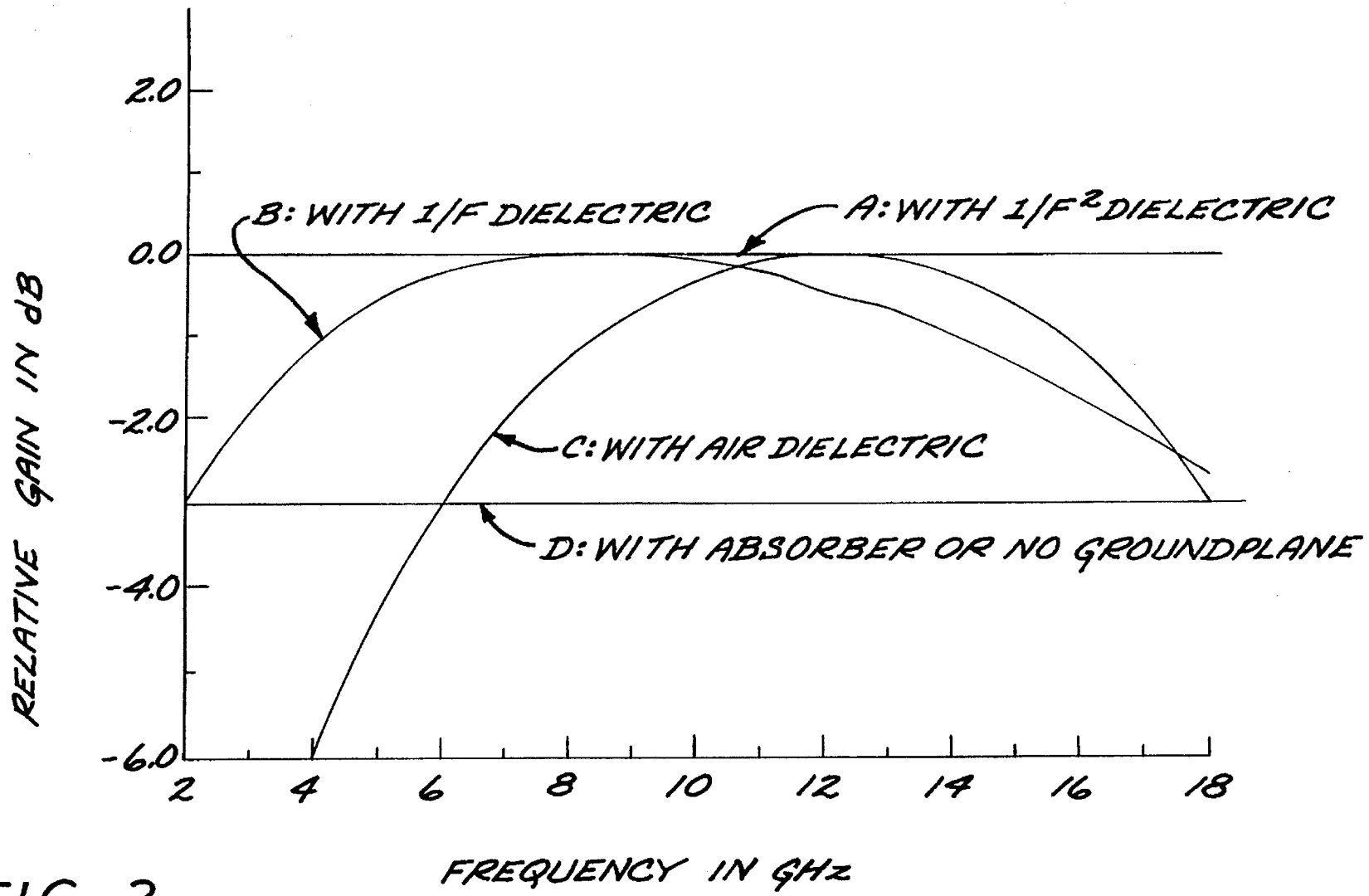
FIG. 3 is a graph illustrating the theoretical effect of several groundplane options on radiator gain.

The invention provides a wideband, efficient solution for minimizing interference of the back-directed wave of a planar radiator with the desired radiation in the forward direction. FIG. 3 illustrates the theoretical effect on radiator gain for several groundplane options. The example chosen operates over the 2.0 to 18.0 GHz frequency band. The computations consider only the interaction of the two components of radiation and neglect variations in element gain with frequency, RF losses and reflections from dielectric interfaces. Without a groundplane the back-directed wave is dispersed in the infinite half-space behind the radiator, which is equivalent to absorbing the energy in a broadband absorber. The relative gain for this case (line "D", FIG. 3) is −3 dB, as one-half the total energy is lost.

Figure 1:
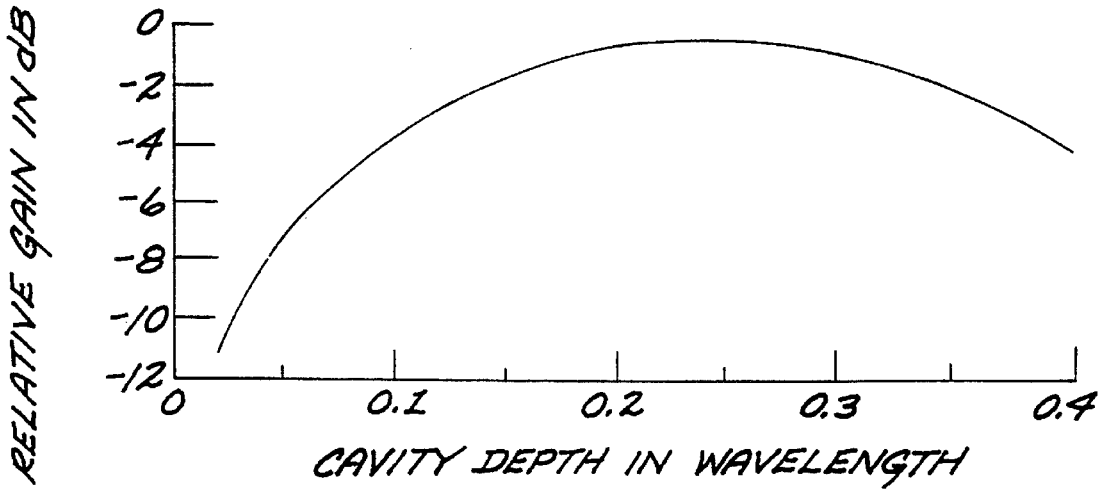
FIG. 1 is a graph illustrating the effect of cavity depth on radiator gain.
Figure 2:
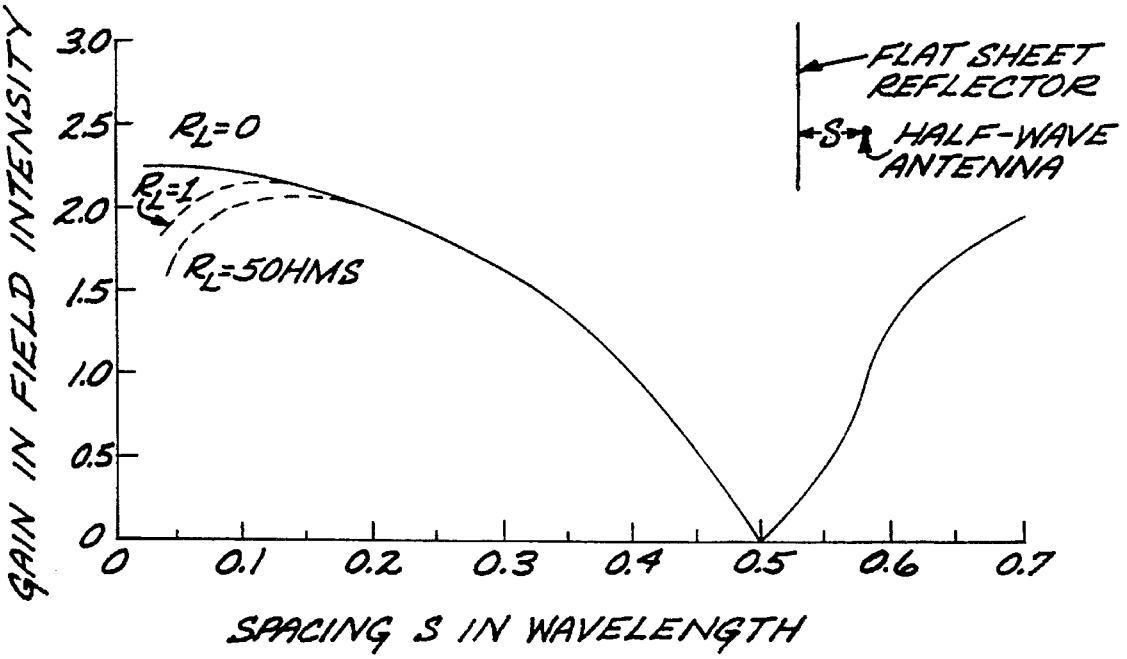
FIG. 2 is a graph illustrating the gain of a dipole radiator as a function of groundplane spacing.

The curve "C" in FIG. 3 is for a groundplane spaced 0.250 inch in air, or one-quarter wavelength at 12.0 GHz, away from the radiator. This curve is similar to FIG. 1 and shows the gain falling off 3 dB at 0.5 and 1.5 times the design center frequency of 12.0 GHz. The −1 dB gain bandwidth is from 8.4 to 15.6 GHz or 60%.

Next, consider that the space between the radiator and groundplane is filled with a low-loss dielectric material with the property that its relative dielectric constant varies with frequency as 1/f. The relative gain for this example is given by curve "B" in FIG. 3. This material is seen to have two effects, to lower the operating band center from 12.0 GHz to about 8.5 GHz, and to broaden the −1 dB gain bandwidth from 4.0 to 14.0 GHz or 111%.

Finally, the line "A" in FIG. 3 illustrates the relative gain for the case when the space between the radiator and groundplane is filled with a low-loss dielectric with the property that its relative dielectric constant varies inversely with the second power of frequency. Line "A" shows that for the ideal, lossless, reflectionless case, full gain could theoretically be realized over the entire operating band.

Figure 4:
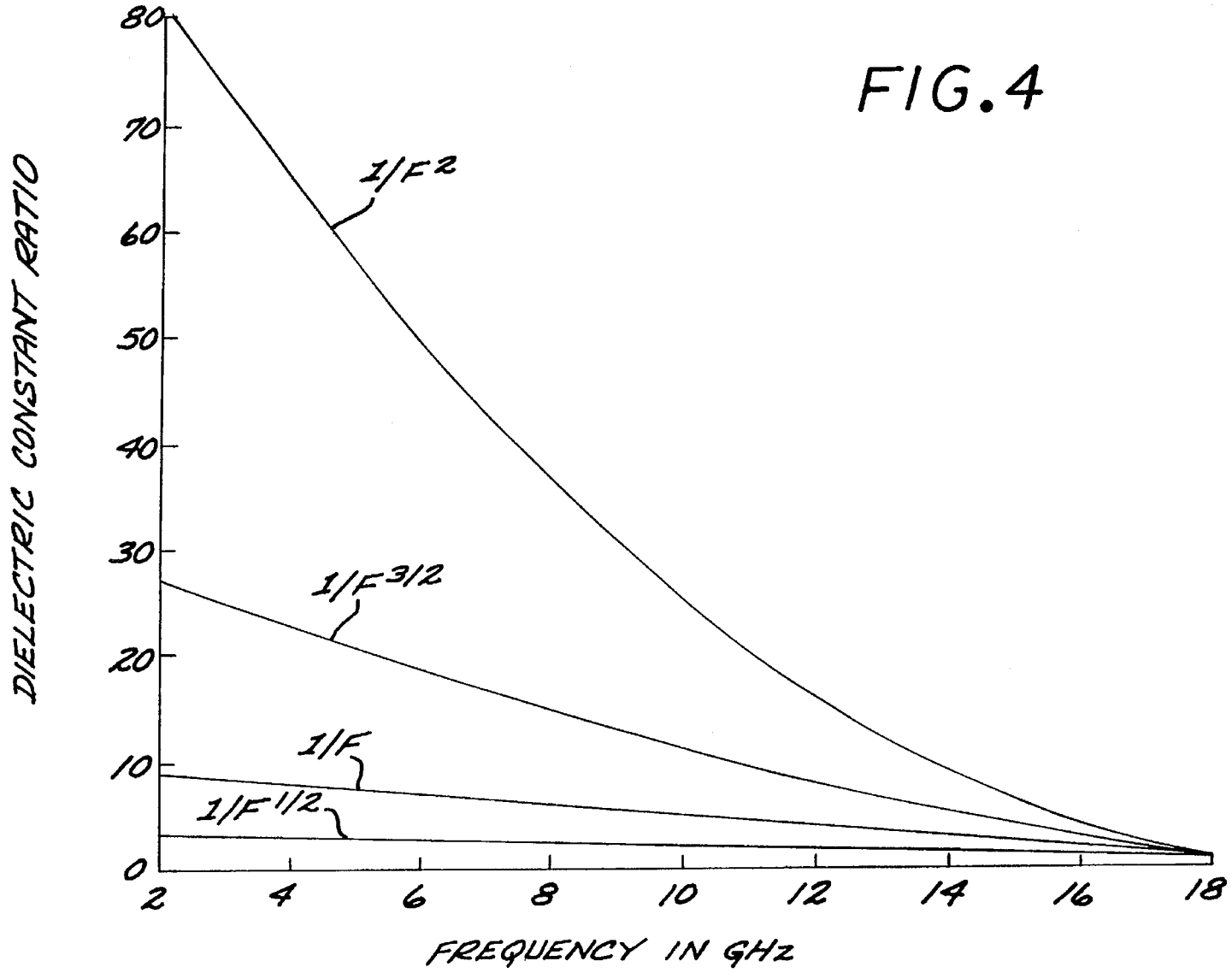
FIG. 4 is a graph illustrating several frequency dependence functions of dielectric material constants.

FIG. 4 shows theoretical curves of relative dielectric constant versus frequency for dielectric materials with $1/f^{1/2}$, 1/f, $1/f^{3/2}$ and $1/f^2$ characteristics referenced to a value of 1.0 at 18.0 GHz.

Figure 5:
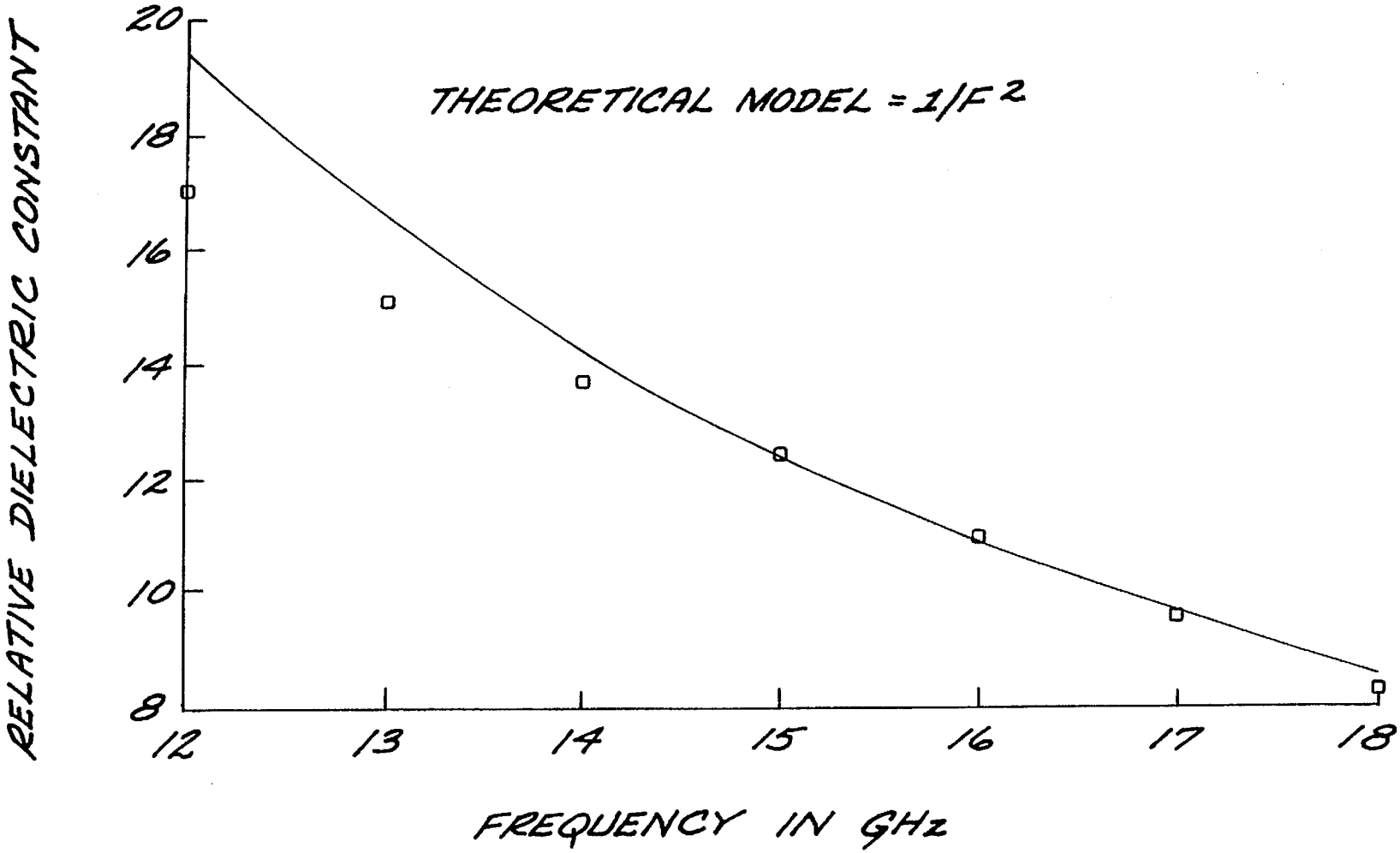
FIG. 5 is a graph illustrating characteristics of a dielectric material embodying the invention.
Figure 6:
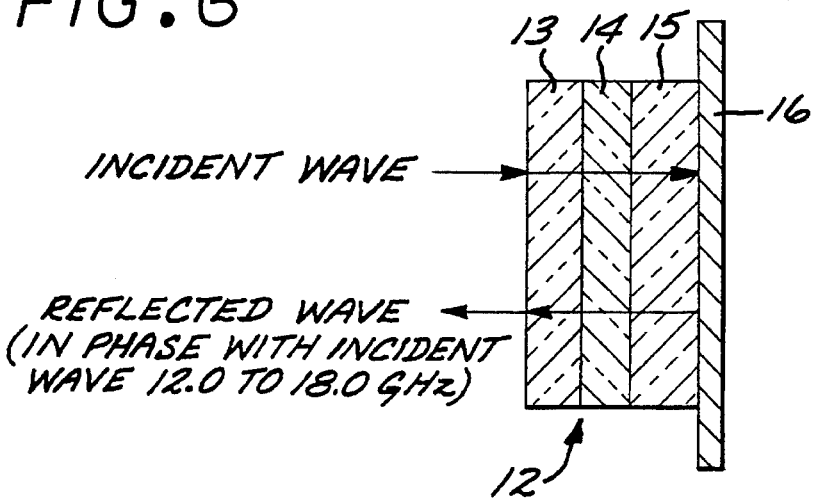
FIG. 6 illustrates construction of the composite multilayer dielectric whose characteristics are shown in FIG. 5.

FIG. 5 shows the predicted characteristic of a composite multilayer material that was modeled, using modern bandpass filter synthesis techniques, to have a dielectric property dependence of $1/f^2$ over the frequency range of 12.0 to 18.0 GHz. FIG. 6 shows how such a dielectric could be fabricated in three layers, with each layer having the thickness and material composition given in the following table. Thus, in FIG. 6 the composite dielectric 12 comprises layers 13, 14 and 15 disposed against a conducting groundplane 16. The layers comprise a substrate material marketed under the name "Eccogel" by Emerson and Cuming; layers 13 and 15 are loaded with inclusions of barium strontium titanate.

| LAYER | t, mm | $Ba_{0.6}Sr_{0.4}TiO_3$ | ECCOGEL |
|---|---|---|---|
| 13 | 1.0 | 72% | 28% |
| 14 | 1.0 | — | 100% |
| 15 | 1.0 | 54% | 46% |

The realization of material that conforms to the $1/f^2$ characteristic over the extended range of 2.0 to 18.0 GHz would require a relative dielectric constant ratio of 81:1, which may be impractical to synthesize as a simple, low RF loss structure. Two alternative approaches are to reduce the operating frequency band over which the $1/f^2$ characteristic obtains, or to effect a lesser degree of inverse frequency dependence than $1/f^2$ over the entire band. A key objective of the invention is to enhance performance of the radiator at the low frequency end of the band. This suggests the possibility of synthesizing a material modelled as a high-pass filter that behaves as a $1/f^2$ dielectric below the filter cut-off frequency, and has little or no frequency dependence above the cut-off frequency. Such a material should be easier to model, as fewer design constraints need to be invoked, and easier to formulate, as the composite structure will require fewer layers with a smaller range of dielectric constants.

Figure 7:
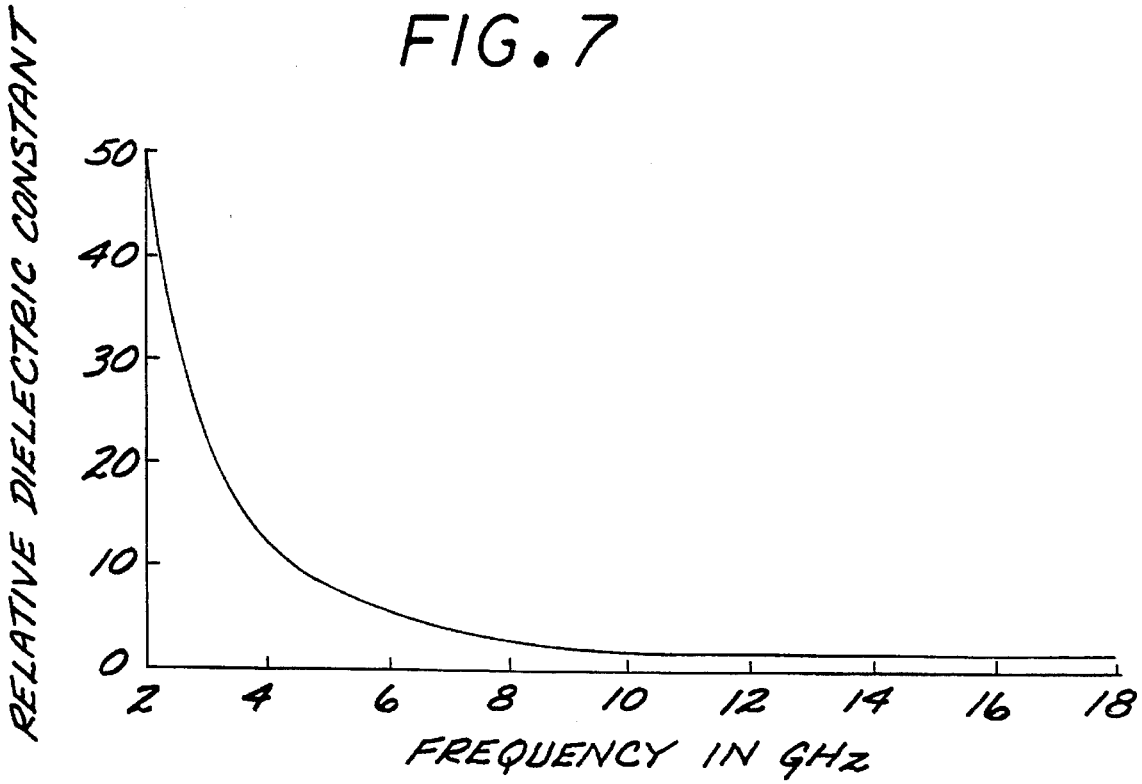
FIG. 7 is a graph illustrating the frequency dependence of the dielectric constant of a dielectric material model in accordance with the invention.

FIG. 7 shows, as an example, the characteristics of a hypothetical dielectric that varies as $1/f^2$ from 50 at 2.0 GHz to 2 at 10.0 GHz, then remains essentially constant up to 18.0 GHz. By adjusting the overall dielectric thickness used in the RF backplane to be nominally one-quarter the electrical wavelength in dielectric at 13.85 GHz, i.e., 0.150 inch, the loss in gain due to misphasing of the back-directed wave would be less than one dB across the entire band for a low-loss dielectric material. In practice, the dielectric constant of the material is measured at the selected mid-range frequency, here 13.85 GHz. The thickness of the dielectric is computed in the following manner. L represents one-quarter wavelength at the selected frequency in free space. $\epsilon_r$ represents the relative dielectric constant of the dielectric material measured for the selected frequency. The thickness L' of the dielectric is equal to $L/(\epsilon_r)^{1/2}$.

An alternative design for achieving a frequency-independent groundplane is to incorporate dielectric materials of the type illustrated in FIG. 4 into the synthesis of conventional multilayer frequency selective surfaces (FSSs). The effect of a quarterwave, frequency independence reflecting groundplane can be approximated by a multilayer FSS that contains alternate layers of low-loss dielectric slabs with specified dielectric constants and thin perforated metallic (mesh) sheets in the appropriate lattice configuration. By increasing the number of layers used in the design, the approximation to a $1/f^2$ characteristic becomes more accurate, however, fabrication is more difficult and costly, transmission losses increase, and higher mismatch occurs due to multiple reflections from the additional layer interfaces. P. Callahan et al., "Influence of Supporting Dielectric Layers on the Transmission Properties of Frequency Selective Surfaces," IEE Proc.-H, Vol. 138, No. 5, October 1991, pp. 448–454. The inverse frequency dependence of these dielectric materials affords the FSS designed with a powerful new degree of freedom for realizing broadband designs that can be used for various applications such as radiator groundplanes, FSSs and wide-angle-inpedance-matching (WAIM) sheets.

Figure 8A:
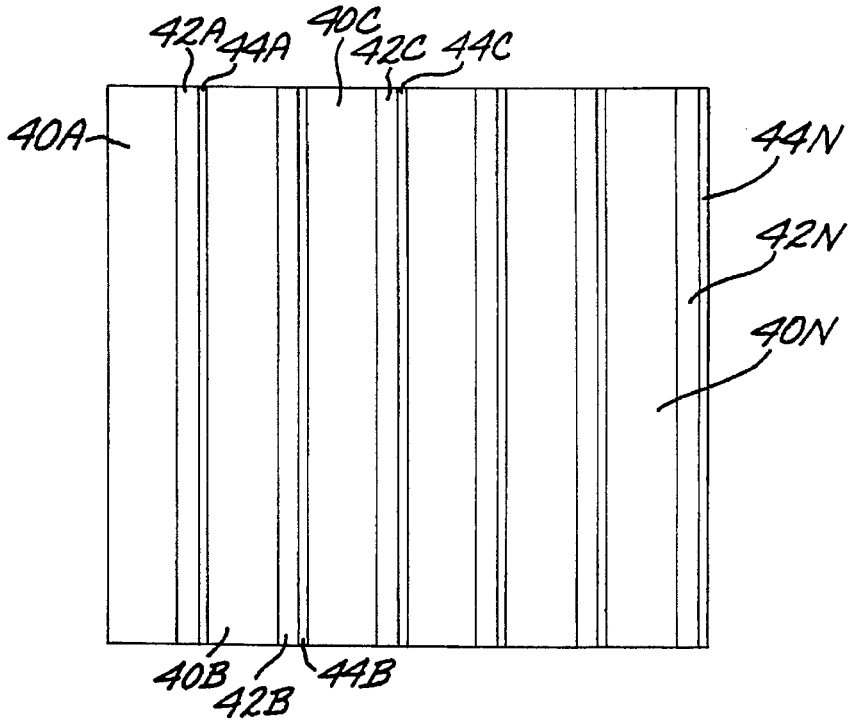
FIGS. 8A and 8B illustrate the use of novel dielectric materials into the synthesis of frequency selective surfaces (FSSs).
Figure 8B:
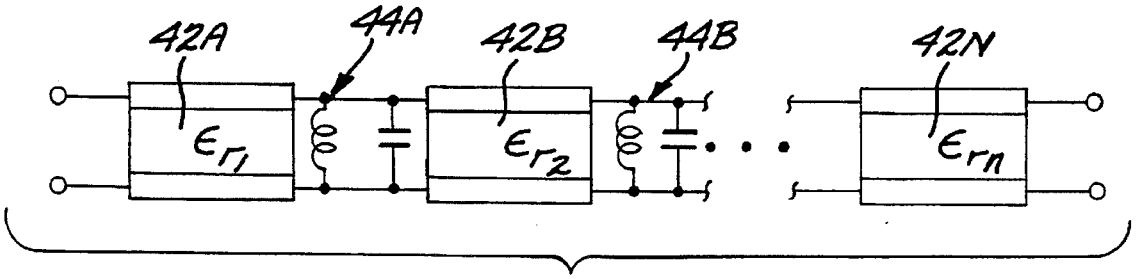

FIGS. 8A and 8B illustrate a multilayer FSS sandwich comprising alternating layers of low dielectric constant spacer material, the dielectric slab, each having the respective required dielectric constant, and the metallic mesh or perforated sheet. Thus, in FIG. 8A, layers 40A-N represent the low dielectric constant spacer layers, layers 42A-N the dielectric slabs and layers 44A-N the metallic meshes. Each slab 42A-N may have a different dielectric constant $\epsilon_1$–$\epsilon_N$. Moreover, the thickness of the respective layers need not be equal.

FIG. 8B is a transmission line model of the multilayer FSS of FIG. 8A. The FSS is modeled as a dielectrically loaded line, with each slab 42A-N characterized by its respective relative dielectric constant $\epsilon_1$–$_N$. The mesh layers 44A-N are modeled as tuned circuits comprising the parallel connection of an inductor and a capacitor.

Figure 9:
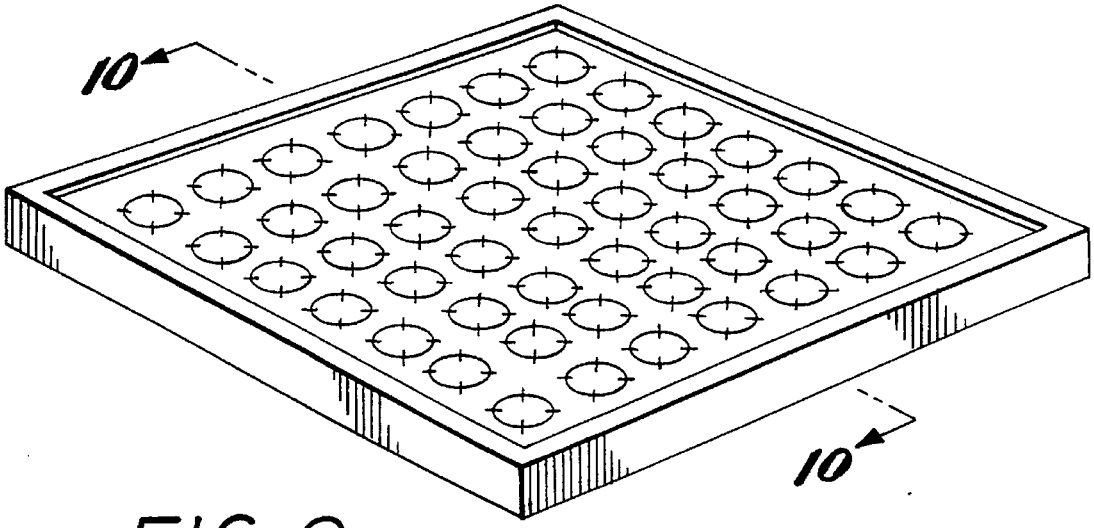
FIGS. 9 and 10 illustrate a conformal antenna array system embodying the invention.
Figure 10:
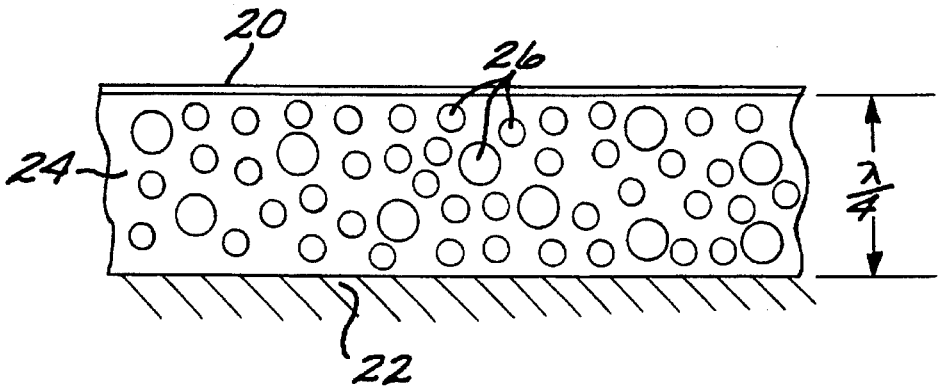

As a particular example of an application employing the present invention, to achieve a frequency independent groundplane, a substrate 24 is sandwiched between a metal groundplane 22 and a periodic array of conformal antenna elements 20, as shown in FIGS. 9 and 10. The requirement of the substrate is that its relative dielectric constant vary inversely with the second power of frequency over the operating band, i.e., $1/f^2$. This is accomplished by loading a substrate uniformly with small metal or dielectric inclusions 26. The capacitive frequency characteristics of the inclusions 26 cause the relative dielectric constant to decrease with increasing frequency, thereby providing the desired frequency dependent behavior.

The substrate material for substrate 24 is selected to have a relative dielectric constant near unity with low loss in the operating band. Possible choices are any of the syntactic foams commonly used in microwave radome fabrication. These materials have relative dielectric constants near unity, extremely low RF losses and good structural integrity. The total number of inclusions to be dispersed in the substrate depends on the desired range of variation of the relative dielectric constant over the operating band and can be determined through a combination of theoretical and experimental procedures. The theoretical value is estimated by solving the electrostatic boundary conditions for inclusions embedded in the substrate at a given spacing. This can be done numerically using standard procedures outlined in R. E. Collin's text, "Field Theory of Guided Waves," at Chapter 12. Next, the spacing between inclusions is determined such that the resulting dielectric constant is made equal to the specified value. A test substrate is fabricated to these spacing parameters and the effective dielectric constant is then measured. The results of these measurements are then used to select an improved value of inclusion spacing. The procedure is reiterated until the desired performance is achieved. The particles could be, for example, aluminum, copper, or silver cubes, spheres or other geometric shapes. Exemplary dielectrics include alumina and barium strontium titanate. Dimensions of the inclusions should be small, typically less than 0.01 of a free space wavelength at the highest frequency in the operating band.

The inclusions are added to a slurry of ground ceramic suspended in a mixture of solvents and binders. A centrifuge is then used to produce tightly packed cast ceramic layers that exhibit high uniformity in density and dispersion of the inclusions. After stacking and curing, the composite multilayer structure thus formulated will provide inverse frequency characteristics that approximate those of the structure modeled theoretically.

Other potential RF and microwave applications for these dielectric materials are: RF transmission media; transitions and matching sections; filters and multiplexers; amplifiers, detectors, mixers, up- and down-converters; loads and terminations; couplers and combiner/dividers; phase shifters and attenuators; RF circuits where ultra-broadband operation is required. The dielectric material may be used in the antenna system described in pending application Ser. No. 07/568,376, filed Aug. 15, 1990, "Embeddable Antenna Subsystem," and assigned to a common assignee with the present application.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A frequency independent radiating element having a signal operating frequency band, said radiating element comprising a radiator which launches a forward-directed wave and a back-directed wave, a reflecting groundplane separated from said radiator by nominal constant spacing distance equivalent to one quarter wave-length at a nominal frequency within said frequency band, and a dielectric material structures disposed between said radiator and said groundplane, said dielectric material structure having an intrinsic, frequency-dependent relative dielectric constant that varies in monotonically decreasing function with inverse frequency dependence for signals within said frequency band, said variation of said dielectric constant occurring intrinsically without application of control signals such that said dielectric material structure simultaneously present different dielectric constants to multi-frequency RF signals propagating through said structure, wherein said back-directed wave passes through said dielectric material structure, is reflected from said group plane, and passes again through said dielectric material structure so that said forward-directed wave and said reflected back-directed wave reinforce one another to improve a radiation efficiency of said radiating element over said frequency band for simultaneous multi-frequency operation, wherein said radiating efficiency is substantially independent of frequency for operation over said frequency band.

2. The radiating element of claim 1 wherein said monotonically decreasing function is $1/f^2$, wherein f represents operating frequency, whereby an effective electrically path length of about one-quarter wavelength is maintained between said radiator and said groundplane over said frequency band, and said band is a wide-octave band, wherein said forward-directed and reflected waves reinforce one another to substantially maximize and radiation efficiency.

3. The radiating element of claim 1 wherein said nominal frequency is a mid-band frequency of said frequency band.

4. The radiating element of claim 1 wherein said dielectric material structure comprises a low loss dielectric having a relative dielectric constant of substantially unity in said frequency band, said substrate being loaded with dielectric inclusions.

5. The radiating element of claim 4 wherein said inclusions have a largest diameter approximately less than 0.01 times the smallest free-space wave-length within said frequency band.

6. The radiating element of claim 1 wherein said dielectric material structure is characterized by a relative dielectric constant that varies inversely with the second power of frequency over said frequency band.

7. The radiating element of claim 6 wherein said dielectric material structure comprises a low loss dielectric having relative dielectric constant of substantially unity in said frequency band, said substrate being loaded with small metal inclusions.

8. The radiating element of claim 7 wherein said inclusion has a largest diameter approximately less than 0.01 the smallest free-space wavelength within said frequency band.

9. The radiating a element of claim 1 wherein said dielectric material structure comprises a low loss dielectric having a relative dielectric constant of substantially unity in said frequency band, said substrate being located with metal inclusions.

10. The radiating element of claim 6 wherein said dielectric material structure comprises a low dielectric having a relative dielectric constant of substantially unity in said frequency band of antenna, said substrate being loaded with metal inclusions.

11. The radiating element of claim 1 wherein said radiation is a planar radiator structure.

12. The radiating element of claim 1 wherein said groundplane is a planar structure.

13. The radiating element of claim 1 wherein said dielectric material structure is a multilayer structure comprising altering layers of low-loss dielectric materials and thin perforated metallic mesh sheets.

14. The radiating element of claim 13 wherein said monotonically deceasing function is $1/f^2$, where f represents operative frequency, whereby an effective electrical path length of about one-quarter wavelength is maintained between said radiator and said groundplane over said frequency band.

15. The radiating element of claim 1 wherein said dielectric material structure comprises a dielectric substance loaded uniformly with inclusion particles, said dielectric substrate fabricated of a low-RF-loss material having a relative dielectric constant which is nominally unity over said operating frequency band.

16. The radiating element of claim 15 wherein said inclusion particles are fabricated of a material comprising aluminum, cooper, silver, alumina or barium strontium titanate.

17. The radiating element of claim 16 wherein said inclusions have a largest diameter approximately less than 0.01 times the smallest free-space wavelength within said frequency band.

* * * * *